US006000643A

United States Patent [19]

Gelder

[11] Patent Number: 6,000,643

[45] Date of Patent: Dec. 14, 1999

[54] SAFETY ENTRANCE FOR GARBAGE GRINDER

[76] Inventor: Charles Van Gelder, 15567 Corte Laguna, Sonora, Calif. 95370

[21] Appl. No.: 08/954,117

[22] Filed: Oct. 20, 1997

[51] Int. Cl.[6] ..... B02C 18/42

[52] U.S. Cl. ..... 241/37.5; 241/46.015; 241/46.016; 241/79.1; 241/81

[58] Field of Search ..... 241/46.013, 46.014, 241/46.015, 46.016, 79.1, 81, 37.5

[56] References Cited

U.S. PATENT DOCUMENTS

| | | | |
|---|---|---|---|
| 2,902,700 | 9/1959 | Chambers | 241/46.016 X |
| 3,149,066 | 9/1964 | Ross | 209/223.1 |
| 3,419,224 | 12/1968 | Mlinar | 241/100.5 X |
| 3,420,455 | 1/1969 | Chorney | 241/46.016 X |
| 4,367,138 | 1/1983 | Kustas | 209/224 |
| 4,494,657 | 1/1985 | OldenKamp | 209/636 |
| 4,706,818 | 11/1987 | Zutell et al. | 209/636 |

*Primary Examiner*—John M. Husar

[57] ABSTRACT

A guarding device to guard a household garbage grinder from inadvertent introduction of metal material into said grinder. The guard comprises a magnet around the entrance to the grinder to form a magnetic field across the entrance so that ferrous metals will be attracted to the magnet.

3 Claims, 1 Drawing Sheet

SAFETY ENTRANCE FOR GARBAGE GRINDER

BACKGROUND AND SUMMARY OF THE INVENTION

This invention pertains to household garbage grinders and more particularly to a grinder having a magnetic guard at the entrance to prevent accidental passage of metal pieces into the grinder.

Grinders for grinding household garbage are commonly placed in the drain of kitchen sinks in many—if not most—households. Such grinders are used to grind vegetable trimmings and waste and to flush the ground material through the waste water pipes and to septic tanks or disposal systems.

Such grinders are not designed for solid metal pieces. However, almost always by accident, metal pieces such as stainless steel flatware are often moved onto the grinder along with the vegetable waste. When that happens, both the flatware and the grinder may be damaged. It is therefore desirable to avoid introduction of such materials into the grinder portion of such a device.

By this invention, a device is provided to inhibit—if not prohibit—movement of much metallic material into the grinder.

DESCRIPTION

Figure 1:
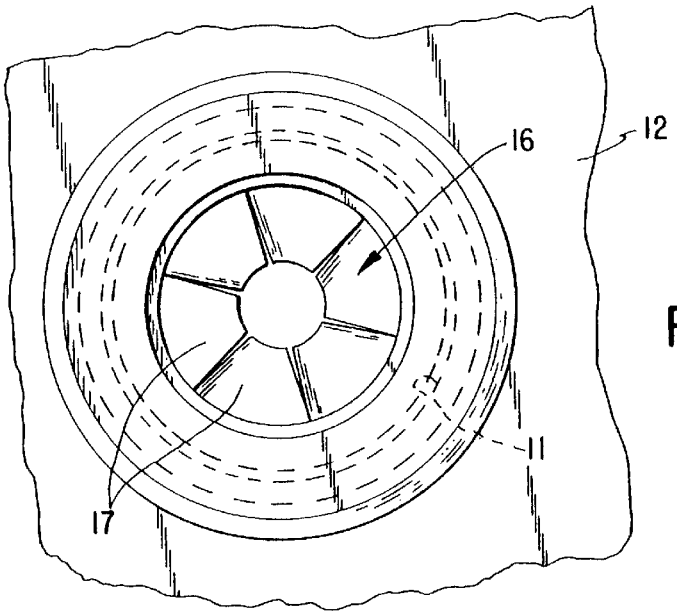
FIG. 1 is a top plan view of a portion of a household sink in which is mounted a grinder including the guard of the present invention.
Figure 3:
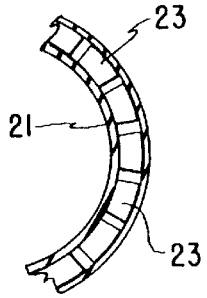
FIG. 3 is a top plan view of an alternate guard formed of segmented pieces.
Figure 2:
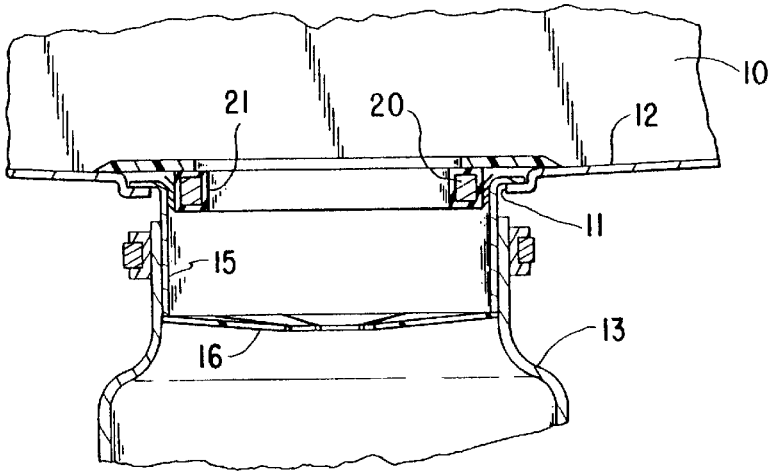
FIG. 2 is a medial sectional view through the entrance of the grinder.

Briefly, this invention comprises an inlet for a household garbage grinder having a magnetic guard to inhibit passage of magnetic materials into the grinder.

More specifically and referring to the drawings, the grinder is normally mounted on the drain for a household (usually kitchen) sink 10. An opening 11 in the bottom 12 of the sink allows installation of the grinder 13.

The usual grinder includes a neck 15 attached to the bottom of the sink and allowing the garbage to be collected for introduction into the grinding component. At the bottom of this neck 17 is a soft rubber-like membrane 16 composed of a series of fingers shaped as sectors of the opening. These fingers 17 allow passage of pieces of garbage, but generally act to avoid spattering of flush water out of the grinding component. At the entrance to the neck 15, the invention proposes to place a highly magnetized ring 20 having one pole to the inside on the ring and the other pole to the outside. This orientation may also be made possible by forming the ring 20 from a series of shorter separate pieces 23 enclosed within a flange 21 forming a ring around the entrance to the neck 15. It will also be apparent that with segments 23, an electromagnetic device might be made possible by providing coils around each segment.

With either solid ring or an assembled ring, the magnetic field formed within the entrance to the neck 15 creates a field that will tend to attract most ferrous metals, and therefore will inhibit the passage of most stainless steel tableware as well as attracting the base metal on which silver plate may be laid. In addition, any stray ferrous metals which find the way to the entrance will also be attracted to the ring 20 and they too may be prevented from entering the grinder. It will be apparent that by use of an open ring, a magnetic field can be created without impeding the flow of materials into the grinder except that pieces of magnetic material such as iron may be stopped.

Thus, the magnetic ring of the invention provides a safety guard both for the preventing the grinder and also preserving the tableware which might otherwise be put into the grinder. Not having to reach into the grinder to retrieve errant metal also may prevent injury to the user.

I claim as my invention:

1. The combination of a household garbage grinder, having an essentially circular entrance, with a guarding system comprising means for setting up a magnetic field around the entrance to the grinder whereby ferrous metal pieces will be inhibited from entering said grinder, said means for setting up a magnetic field comprising a magnetic ring comprised of a series of segments arranged in the form of an open ring surrounding and not impeding said entrance.

2. The combination of claim 1 in which each segment is an electromagnet.

3. The combination of claim 1 in which said entrance is formed as a toroidal tube, said segments being enclosed in said tube.

* * * * *